US006382431B1

(12) United States Patent
Burke

(10) Patent No.: US 6,382,431 B1
(45) **Date of Patent: *May 7, 2002**

(54) SHELF MANAGEMENT SYSTEM

(75) Inventor: Robert P. Burke, Laguna Niguel, CA (US)

(73) Assignee: Burke Display Systems, Inc., Dana Point, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/518,341

(22) Filed: Mar. 3, 2000

(51) Int. Cl.[7] ..... A47F 1/04
(52) U.S. Cl. ..... 211/59.3; 211/184
(58) Field of Search ..... 211/59.2, 59.3, 211/51, 46, 120, 134, 184; 312/61, 71, 183

(56) References Cited

U.S. PATENT DOCUMENTS 4,300,693 A * 11/1981 Spamer ..... 211/51
4,901,869 A * 2/1990 Hawkinson et al. ..... 211/59.3
5,069,349 A * 12/1991 Wear et al. ..... 211/59.3
5,111,942 A * 5/1992 Bernardin ..... 211/59.3
5,123,546 A * 6/1992 Crum ..... 211/59.3
5,240,126 A * 8/1993 Foster et al. ..... 211/59.3
5,450,969 A * 9/1995 Johnson et al. ..... 211/59.3
5,562,217 A * 10/1996 Salveson et al. ..... 211/59.3
5,665,304 A * 9/1997 Heinen et al. ..... 211/59.3
5,685,664 A * 11/1997 Parham et al. ..... 211/59.3
5,839,588 A * 11/1998 Hawkinson ..... 211/59.3
5,855,283 A * 1/1999 Johnson ..... 211/59.3
5,878,895 A * 3/1999 Springs ..... 211/59.3
5,881,910 A * 3/1999 Rein ..... 211/59.3
5,992,652 A * 11/1999 Springs ..... 211/59.3
6,105,791 A * 8/2000 Chalson et al. ..... 211/59.3
6,142,317 A * 11/2000 Merl ..... 211/59.3

* cited by examiner

*Primary Examiner*—Daniel P. Stodola
*Assistant Examiner*—Jennifer E. Novosad
(74) *Attorney, Agent, or Firm*—Knobbe, Martens, Olson & Bear, LLP

(57) ABSTRACT

An adjustable shelf management system which removably attaches to a shelf. The system stores and displays products of a variety of shapes and sizes and automatically delivers the products to the front of the rack. The adjustable shelf management system includes a frame and a product supporting and feeding assembly. The assembly includes product tracks that can be added or removed as needed and that can be separated by varying distances depending on the width desired. The assembly also includes dividers. The product tracks and dividers can be separate or integral. The product tracks have raised rails extending from a front of the system to a back of the system for attachment of a removable pusher block and a roll spring which urges the pusher block forward. Additionally, a spacer block can be fitted onto the pusher block to increase its height and width or used to change the spacing between the tracks. The tracks attach to the front of the shelf by insertion into a slot.

53 Claims, 11 Drawing Sheets

SHELF MANAGEMENT SYSTEM

FIELD OF THE INVENTION

The present invention generally relates to an adjustable shelf management system. More specifically, the present invention relates to an adjustable forward feeding display shelf management system for storing and displaying merchandise of a variety of shapes and sizes and automatically delivering the merchandise to the front of the shelf in seriatim. The shelf management system removably attaches to a shelf by inserting into a slot in the shelf.

BACKGROUND OF THE INVENTION

Shelving is used extensively for stocking and storing products or merchandise in a variety of stores. Most stores have immovable shelving which is arranged back-to-back between aisleways. The nature of the fixed shelves makes it difficult to add and remove products. Moreover, such shelves make difficult the rotation of the shelved products, which involves moving the older stock to the front of the shelf and positioning new stock behind the older stock. Shelves are often configured to have a slot in the as front and may have a slot in the back.

In order to automatically move products forward as they are removed, numerous forward feed devices have been devised. These devices fall into three categories. The first category is inclined tracks relying on gravity to feed the product forward. Gravity feeding is unpredictable in that various materials slide easier than others because of different weights and frictional interfaces between the products and the track. The second category tries to overcome these problems by adding conveyor belts which still use gravity to effect forward movement. Of course, such devices are cumbersome, expensive and complicated due to the need to properly tension and track the conveyor belts.

The third category uses springs to feed the product forward. The springs result in a simple, inexpensive design which will smoothly move products forward. There have been a number of variations on this type of design.

SUMMARY OF THE INVENTION

Many spring-biased devices have the disadvantage that they can only be used for a very limited size of product. In addition, even if designed for variations in size, the designs are complicated and difficult to alter. Moreover, it has been discovered that most spring biased devices cannot tolerate high loads and that such loads may often disengage the spring-biasing assembly from the shelf management system.

Accordingly, the present invention involves an adjustable forward feeding shelf management system. The shelf management system is adjustable in a direction transverse to the direction of feeding, meaning the present display system is specifically designed to adjust to compliment containers and packaging having various widths. Moreover, the present display system also involves a simplified assembly process, as well as a stable spring biasing assembly. The present display system also benefits from a stable connection to the shelf, such that the product tracks and any dividers in-between the product tracks are securely locked to the front and optionally also to the rear of the shelf management system while still allowing the tracks and dividers to translate transverse to the front and rear of the shelf management system. The shelf attachment allows the product tracks and any dividers to snap into the shelf such that the tracks are stably and reversibly attached to the shelf, but the width can be easily adjusted.

Accordingly, one aspect of the present invention involves an adjustable shelf management system for storing and displaying products in a shelf-like orientation. The display reversibly attaches to the shelf at the front panel and alternatively, also to the back. The front panel and back panel extend generally parallel to one another and are separated by a fixed distance. The shelf management system further comprises one or more product tracks having raised rails extending generally transverse to the front and back panels and a removable pusher block slidably attached to the product track. The front panel and alternatively the back panel may include races that extend along the front and back panels or the front or back panel may be securely fastened onto the tracks as by riveting or gluing, for example. A biasing member biases the pusher block forward, and at least one divider is positioned between two adjacent product tracks. The product tracks and dividers may be slidably attached to the races of the front panel and also may be attached to races at the rear panel which allow for translational movement of the product tracks and dividers. Alternatively, the front or rear panel may be fastened to the product tracks and or dividers and individually attach within the slots on the shelves. The races at the front panel are composed of a flange which extends along the front panel and the shelf surface on the bottom. The back races may be the same as the front races or may simply comprise the shelf surface.

Yet a further aspect of the present invention involves a pusher block and track combination. The track includes a pair of raised rails having a generally T-shape. The pusher block has at least two sets of opposing flanges, wherein the opposing flanges attach to one of the rails at more than the top and outside surface of the rail, whereby the rail is captured between the set of opposing flanges, but slides backward and forward on the flanges.

A further object of the invention is an adjustable shelf management system for storing and displaying products in a shelf-like orientation. The system reversibly attaches to a shelf at the front panel and optionally also at the back panel. The front and back panels extend generally parallel to each other and are a substantially fixed distance relative to one another. The front panel and the back panel may include races and corresponding removable pusher block assemblies. Alternatively, the front or back panel may be fastened onto separate product tracks and/or dividers. The rack further comprises one or more product tracks. The product tracks include raised rails extending generally transverse to the front and back panels and being generally T-shaped. The removable pusher block assembly includes a pusher block slidably attached to the product track. The pusher block comprises two sets of opposing flanges. The flanges are arranged to capture the rails on both side edges of both rails. The pusher block assembly also has a biasing member urging the pusher block forward along the track. At least one divider is positioned between two adjacent product tracks and the product tracks and dividers are slidably attached to the races to allow movement of the product tracks and dividers from side to side along the front panel and the rear panel.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which.

DETAILED DESCRIPTION OF THE PREFERRED EMBODIMENT

Figure 1:
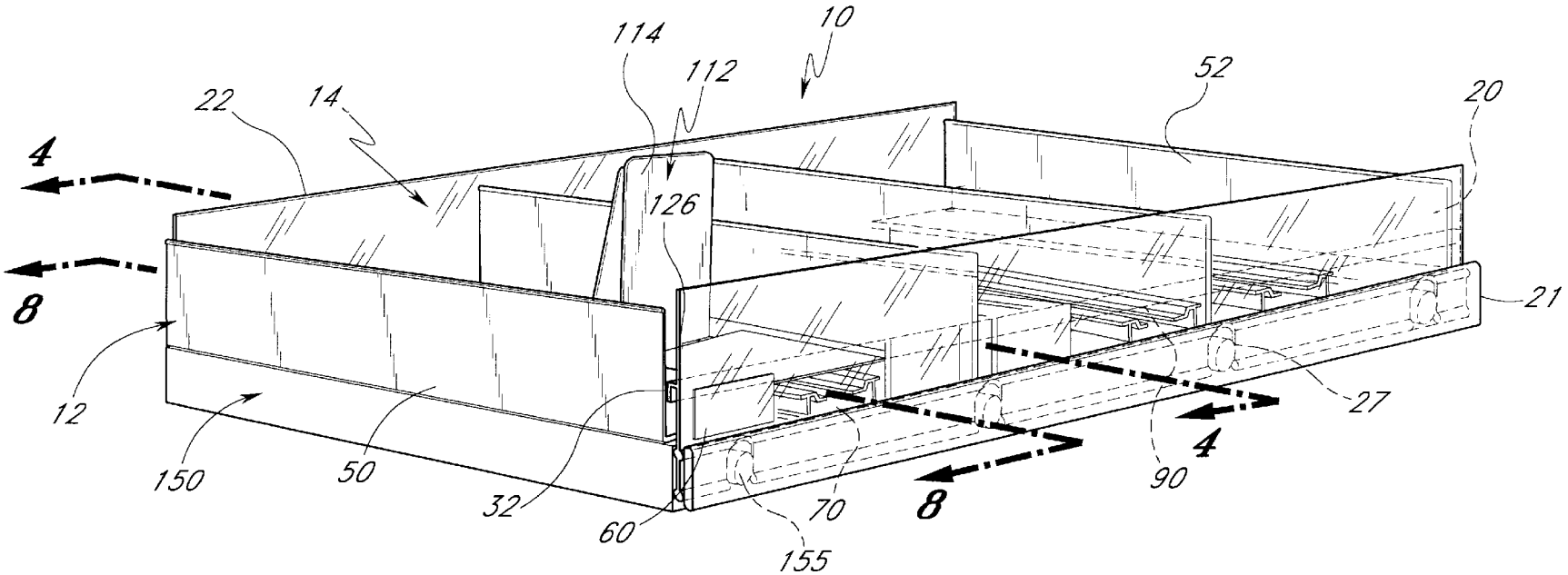
FIG. 1 is a perspective view of an adjustable shelf management system having various features, aspects and advantages in accordance with the present invention.

With reference initially to FIG. 1, an adjustable shelf management system, generally designated by reference numeral 10, which reversibly attaches to a shelf, is illustrated. The adjustable shelf management system is configured and arranged to accept packages of various sizes, weights and configurations. For instance, the present adjustable shelf management system may be used with prepackaged and bagged salads and other types of produce. Additionally, in one embodiment, the present adjustable shelf management system 10 may have particular utility with pharmaceutical products, such as drugs and vitamins. While the present invention is typically used with comestible products in stores such as grocery stores and convenience marts, the present adjustable shelf management system may find utility in a variety of other environments, including warehouses, hospitals, drug stores, and office supply rooms, auto parts stores and clothing stores, for instance, but without limitation.

The present adjustable shelf management system 10 is generally comprised of a frame 12 and a product supporting and feeding assembly 14. The illustrated frame 12 is not a single piece, nor does it require a permanent or semi-permanent attachment, the size is dictated by the size of the shelf or the area of the shelf to be used. The frame 12 has a front 20 which attaches it to the shelf 150. The back of the frame 22 may have a number of alternative arrangements. It may not have a back 22 at all, it may have a back 22 which simply holds the product supporting and feeding assembly in place, or it may have a back 22 which is similar to the front 20 and helps to attach the shelf management system 10 to the shelf 150. In addition to or in lieu of a back 22, the product track may have a magnetized plate attached to the bottom which allows for attachment at the back. The front 20 and/or back 22 may also be permanently attached to the product tracks and/or divider. In addition, the front 20 may be as short as about the width of the product track, divider, or combined product track/divider or may be the length of the shelf. All of the alternatives will likely depend on the type of shelf 150 or drawer which is to be used. Such a slideable mounting assembly will ease the rotation of product positioned within the shelf management system 10 by allowing the stock person full access to the full dimension of the product supporting and feeding assembly 14.

Figure 4:
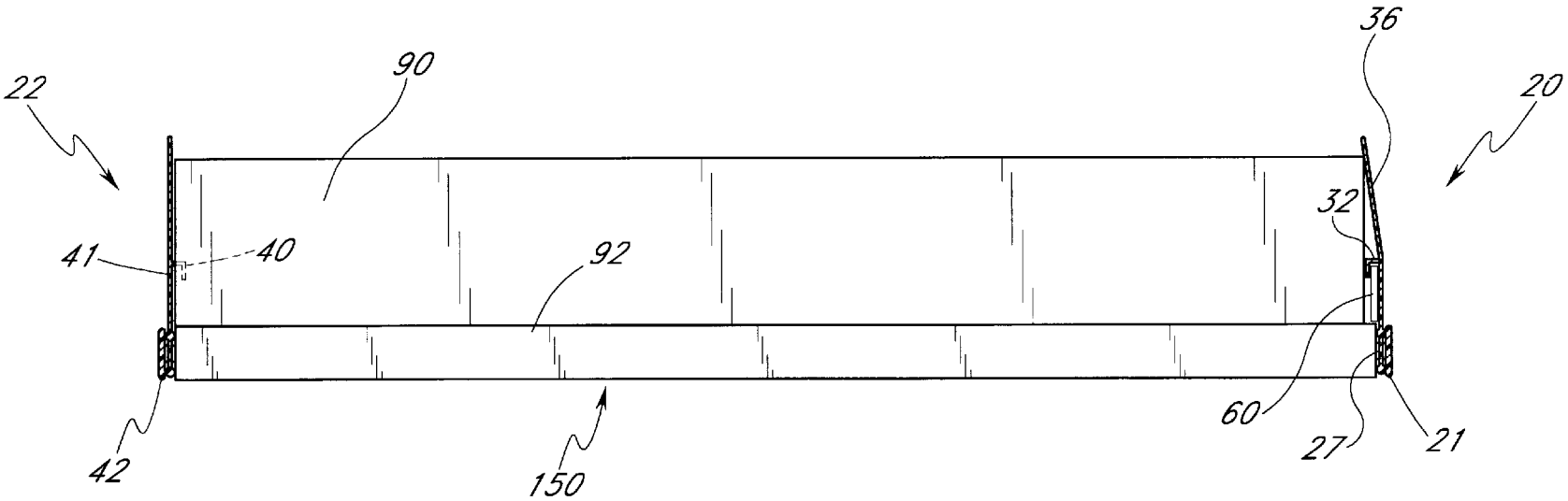
FIG. 4 is a sectioned view of the adjustable shelf management system of FIG. 1 taken along the line 4—4.
Figures 10, 10A:
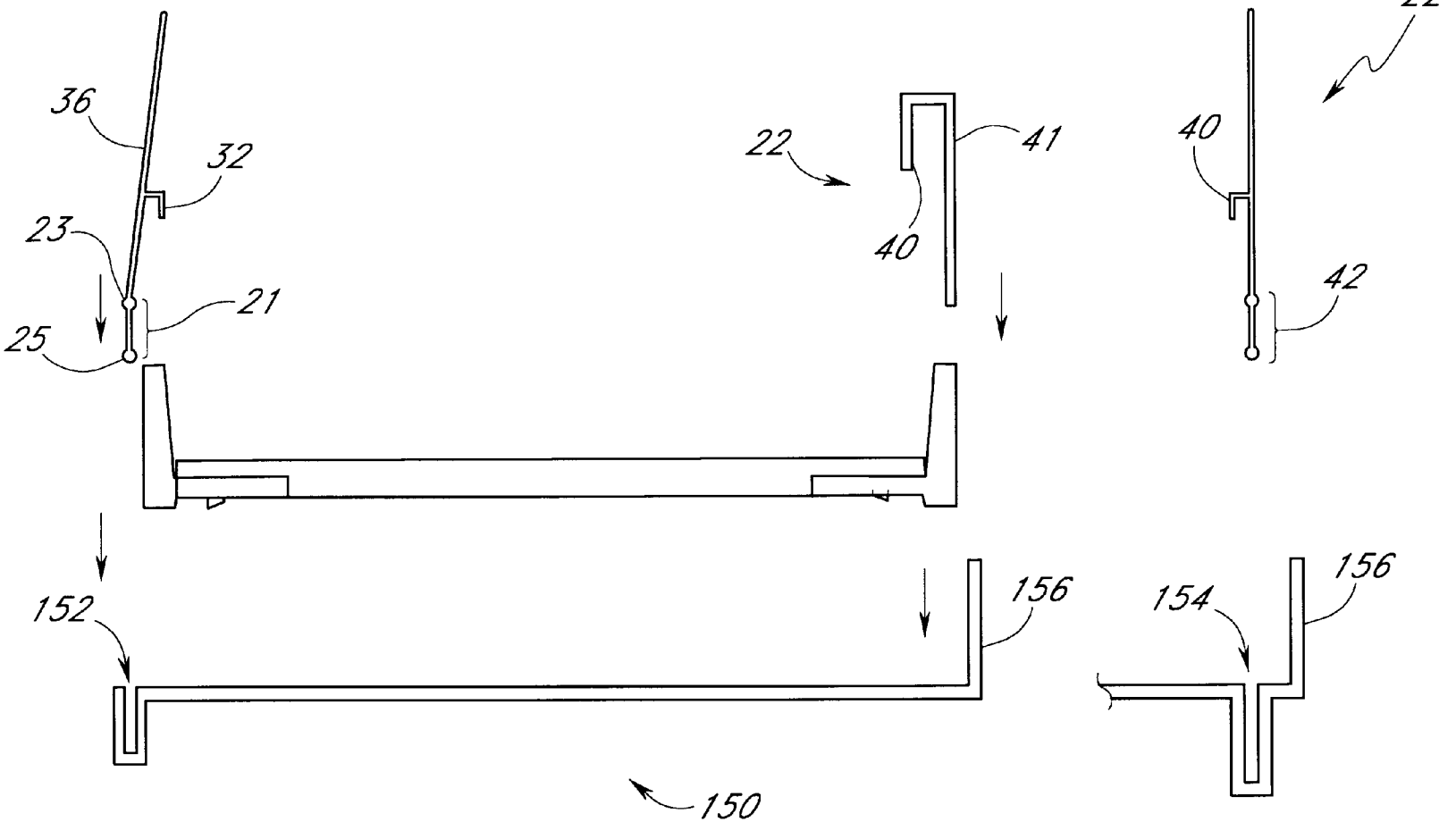
FIG. 10 is a side view of an embodiment in which the product tracks and dividers are snap fit into the shelf in front and the backs are held in place.
FIG. 10A is a variation of FIG. 10.

With continued reference to FIG. 1, the frame 12 generally comprises a first and alternatively second end. In the preferred embodiment the first and second end are a front panel 20 and a rear panel 22. The rear panel 22 may be formed similarly to the front panel 20 and allow for attachment to the shelf or the rear panel may be simply designed to hold the product tracks in place a fixed distance from each other. The panels 20, 22 extend generally parallel to one another at a substantially fixed separation distance. With reference now to FIGS. 1, 4, and 10, the panels 20, 22 will be discussed in detail in seriatim beginning with the front panel 20. The front panel 20 is generally planar and extends generally vertically. The front panel 20 also comprises a rearward-facing upper flange 32, which, with the shelf surface comprises a race. The race is preferably sized and configured to allow free movement of product tracks and dividers in a manner which will be described in greater detail below. The front panel 20 also comprises a flange or shelf attachment extension 21 which is generally co-planar with the main body of the front frame 20 and includes two protuberances, 23 and 25. These protuberances 23 and 25 allow the shelf attachment extension 21 to be stably inserted into a slot 152 in the shelf 150 and to be frictionally engaged in the slot 152. The flange or shelf attachment extension 21 may also comprise one or more cut-outs 27 which provide clearance for bars 155 in the slot 152. With continued reference to FIGS. 1, 4, and 10, the upper portion of the front panel 20 serves as a product retaining wall 36 which desirably extends upward and preferably angles slightly rearward from a location above the upper flange 32. The product retaining wall 36 serves as a forward-most stopping surface for the adjustable shelf management system 10 and is desirably angled rearward to help pinch and hold product within the adjustable shelf management system 10 while the product is being urged forward in the manner described in greater detail below.

Figure 8:
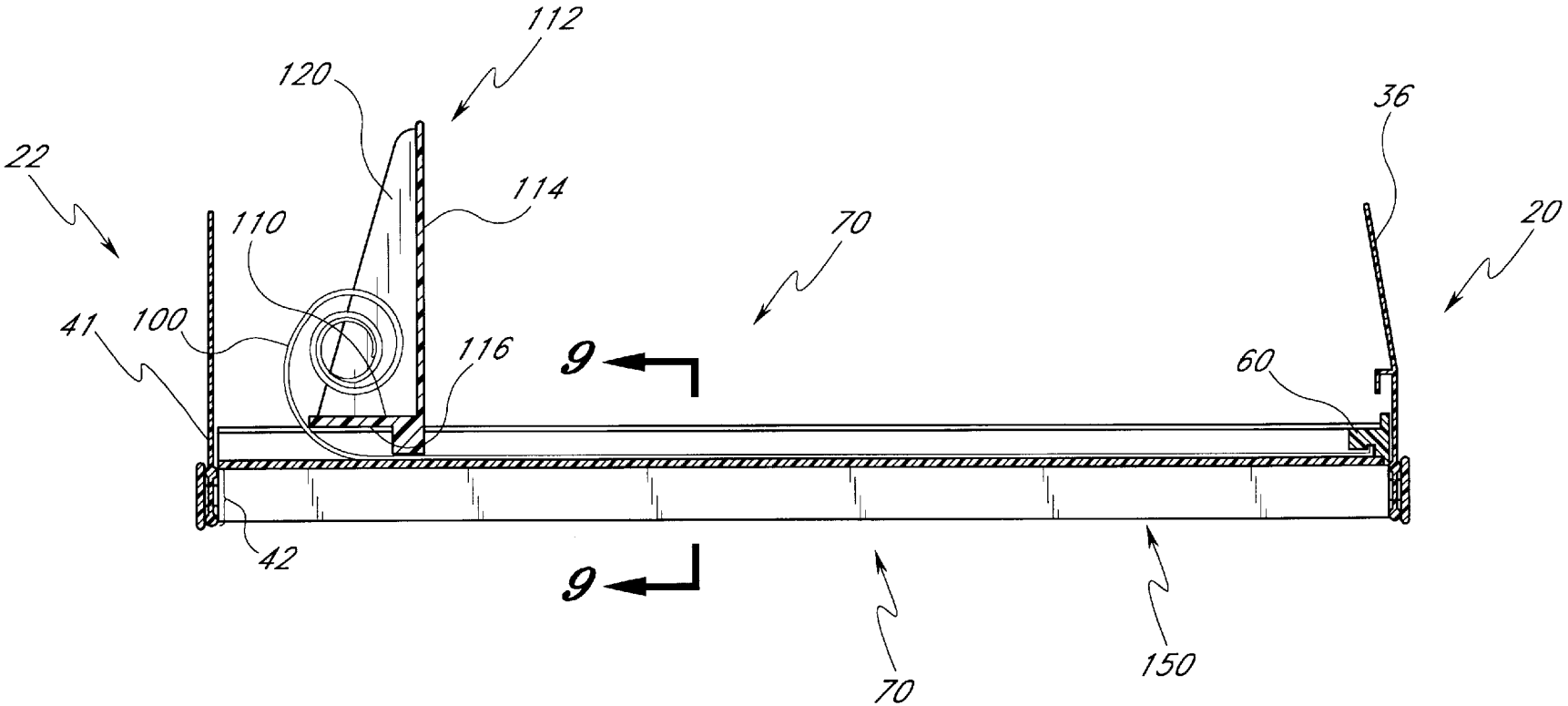
FIG. 8 is a sectioned view of a product track configured and arranged in accordance with various features, aspects and advantages of the present invention taken through line 8—8 of FIG. 1.

The rear panel 22 is advantageously configured such that it will attach over and hold plural product tracks 70 and dividers (described below) moveably in place and may also attach to the back of the shelf. The rear panel may be configured to simply hold the product tracks 70 stably and may generally comprise an upper flange 40 and a back surface 41 which may attach over the back of the product tracks or alternatively attach over the product tracks and shelf back 156 (see FIG. 10). Alternatively, as shown in FIGS. 4, 8, and 10A, the rear panel 22 may be identical to the front panel 20 and thus, comprise a lower shelf attachment extension 42. As with the front panel 20, the upper flange 40 and the lower shelf attachment extension 42 generally allow the product tracks to be stably held so as to define a width for the product as well as to hold the product tracks to the shelf at both the front and the back. The shelf attachment extensions 21, 42 desirably extend the length of the shelf slot 152, 154. The greater extension increases the surface contact area between the product tracks and the shelf 150. Alternatively, it may not be necessary to have a rear panel 22 at all.

With reference again to FIGS. 1–3, the frame 12 of the present adjustable shelf management system 10 also generally comprises a first and second side. In the preferred embodiment, the first and second side are end pieces 50, 52. The end pieces 50, 52 may be distinct elements or may be portions of the product supporting and feeding assembly 14 which will be discussed in detail below.

Figure 5:
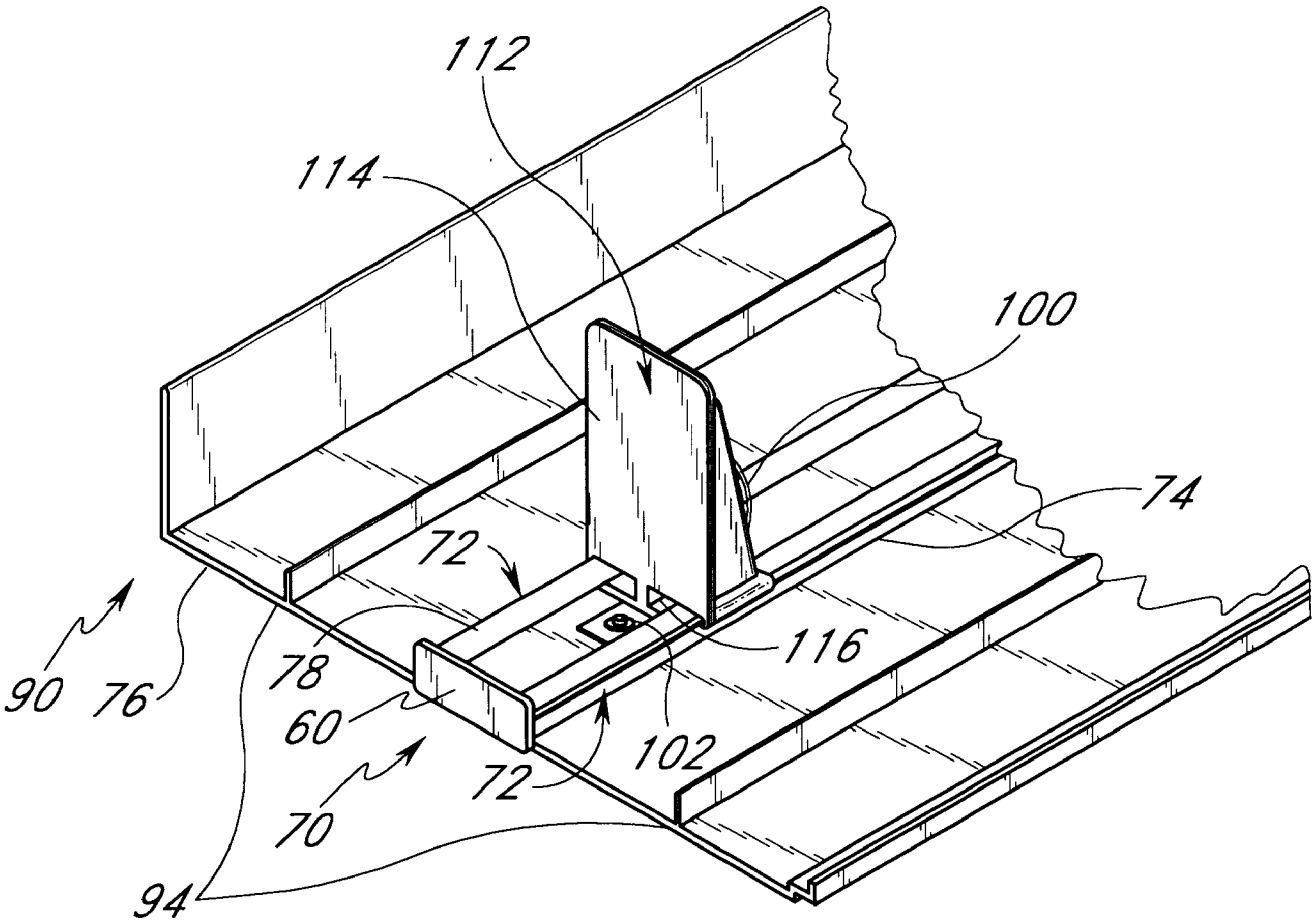
FIG. 5 is a perspective view of a portion of the adjustable shelf management system of FIG. 1.

In the illustrated shelf management system, the end pieces 50, 52 are distinct elements. With reference to FIGS. 1 and 5, the left end piece 50 may be attached to the front panel 20 and the rear panel 22 through the use of an end clip 60. The end clip 60 may be attached to the left end piece 50 in any suitable manner. In the illustrated embodiment, the left end piece is formed as a section of track which has a configuration which will be described below. However, the end clip 60 slides into a portion of the track and is allowed to be fixed within the track without the use of any glue or other adhesive material. The end clip will be described in more detail later, but slides into the rails/ridges 72 of the product track 70 and/or the dividing wall 90 at one or both ends.

The removability of the end pieces 50, 52 creates a self-contained shelf management system 10 that may be reconfigured for various size products quickly and easily by removing one of the end pieces 50, 52 or both of the end pieces 50, 52 and altering the size or lateral dimension of any of the members of the product supporting and feeding assembly 14 which will be described in detail below.

The shelf management system also comprises a track to underlie a plurality of products. The track extends longitudinally between first and second ends, and laterally between first and second sides. In the preferred embodiment the track comprises the product track 70. With continued reference to FIG. 1, the present product supporting and feeding assembly 14 will be described in greater detail. As illustrated, the present product supporting and feeding assembly 14 generally comprises a number of product tracks 70 and dividers 90. In some instances, the product tracks and dividers are integrally formed (i.e., formed of a single piece—see FIG. 5) and in other instances, the product tracks are separate from the dividers to add increased flexibility to the sizing of the products which may be carried by the product tracks and dividers (see FIGS. 6 and 7). In either case, in one embodiment, the separate product tracks 70 and dividers 90 can each have a separate front 20 (see FIG. 11) or the integrally formed product track and dividers can have a combined front 20 (see FIG. 10). In either case, the separate pieces each have an extension 21 to fit within the slot 152 of the shelf 24. In most instances, the dividers 90 will include a portion or a segment of product track to allow the divider to also function as a support surface. Moreover, the product tracks 70 and the dividers 90 having support surfaces will use ridges to decrease the contact surface area between the packages and the product supporting and feeding assembly 14 such that friction may be reduced between the products and the assembly 14. With this introduction, the assembly 14 will be described.

Figure 6:
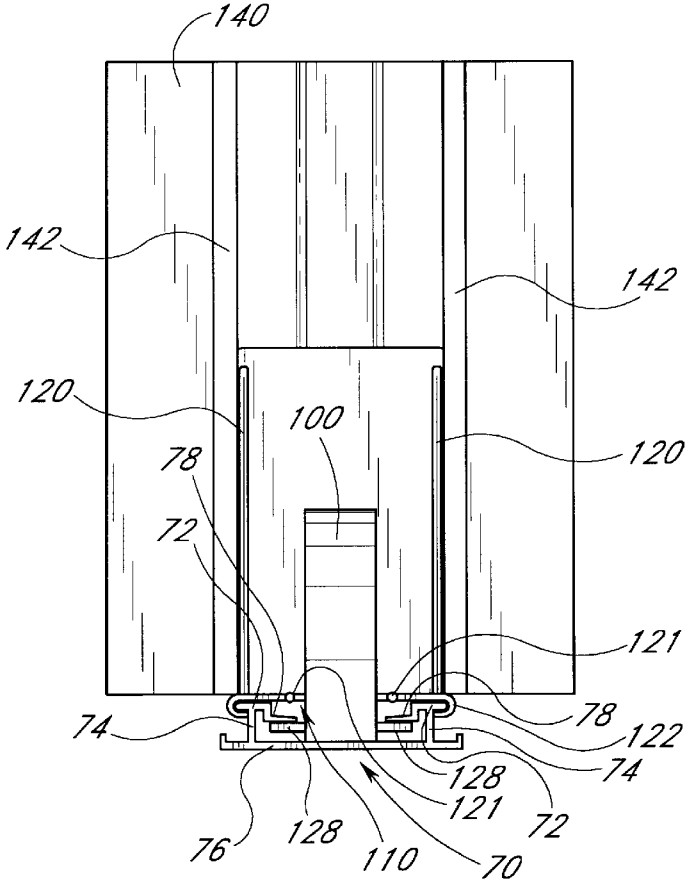
FIG. 6 is a rear sectioned view of a single product track and block of the adjustable shelf management system as that illustrated in FIG. 1.

With reference now to FIG. 6, a typical product track 70 arranged and configured in accordance with the present invention will be described in detail. While the illustrated product track 70 is but one configuration for such tracks, it is the presently preferred embodiment. The product track 70 generally comprises a pair of rails or ridges 72 that extend in a collinear fashion substantially the depth of the shelf management system 10. The rails 72 have a flattened upper surface to slightly increase the support surface area for carrying product. The upper surface, however, is not so large that an increased friction may result such that product cannot be moved under the available forces for the product supporting and feeding assembly 14. The rails 72 further comprise a generally vertically extending rib 74. The rib 74 spaces the rails 72 from a lower support surface 76. As illustrated clearly in FIG. 6, the rails, rib and lower support surfaces 72, 74, 76 create a double I cross-sectional shape. The lower support surface 76 is preferably continuous between the two sets of rails and ribs 72, 74. It should be understood that while the presently preferred product track 70 is a straight extrusion of the plastic material, it is envisioned that the rib or the lower support surface 74, 76 may be intermittent along the length of the rails 72 such that the rib 74 or the lower support surface 76 is not continuous with the entire length of the rails 72. With continued reference to FIG. 6, the rails 72 terminate at an inward edge with a sloping tie down surface 78. The tie down surface 78 cooperates with a pusher block or product pusher which reciprocates along the longitude of the product track in manners which will be described in greater detail below.

The tracks are slidably engaged at one or both ends in a first and second guide lying transverse to the longitudinal extensions of each track. In the preferred embodiment the guides are races which are composed of flanges 32, 40 and the shelf surface, and the tracks are product tracks 70. With reference now to FIGS. 8 and 4, it can be seen that both ends of the product track 70 extend to the flanges 32, 40 and are captured therein with an end clip 60. In this manner, each of the product tracks 70 are generally restrained for translational movement from side to side along the front panel 20 and the rear panel 22 and attach to the shelf at one or both ends. Additionally, this configuration results in a secure connection of the product tracks 70 with the frame 12 such that the product track 70 cannot flop around. The end clip 60 may be attached to the product track 70 in any suitable manner, including friction fitting, threaded fasteners, fasteners, detents, and any other suitable method, including a permanent attachment.

Figure 2:
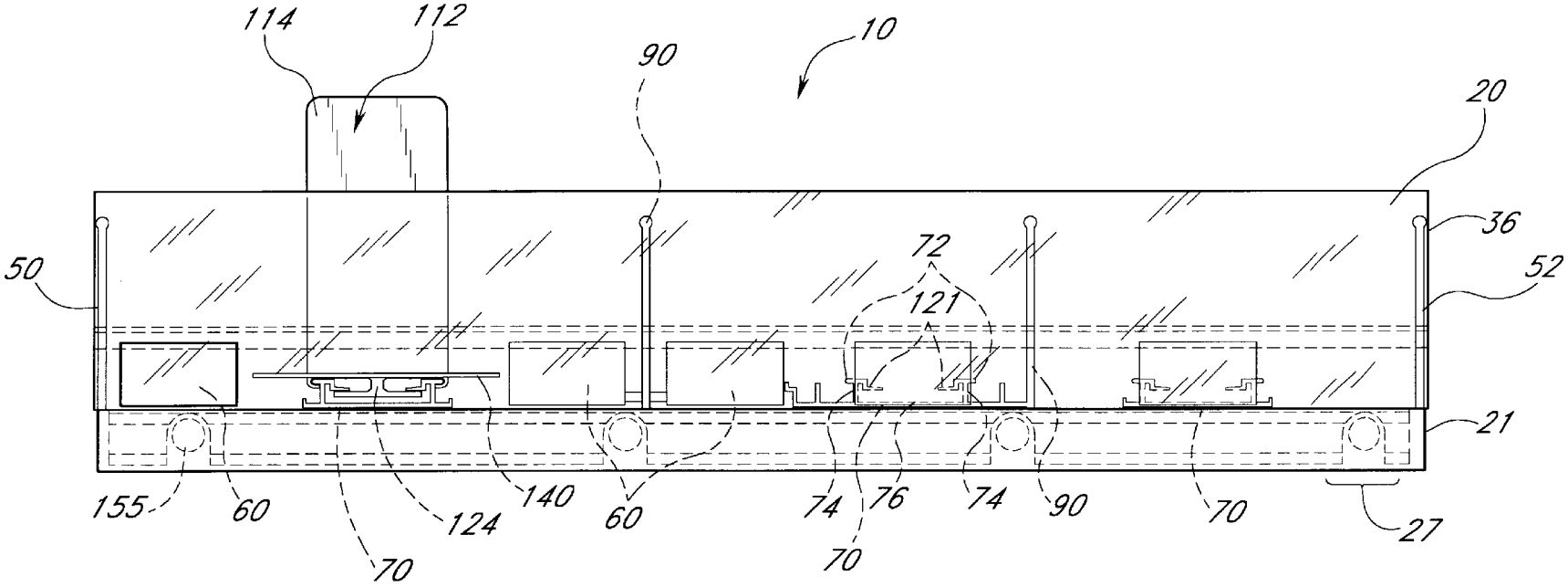
FIG. 2 is a front elevation view of the adjustable shelf management system of FIG. 1.

With reference now to FIG. 2, two adjacent product tracks 70 are preferably separated by a dividing wall 90 such that product carried by one product track 70 will not interfere with the movement of product carried by an adjacent product track 70. The dividing wall 90 may take on any suitable configuration and in some embodiments, carries the same cross-sectional profile as a product track with the addition of an upward extending wall at one outer edge of the lower support surface 76. In some embodiments, the dividing wall 90 has an L-shaped configuration, while in other embodiments the dividing wall 90 has a T-shaped configuration. It is also possible to configure a dividing wall 90 without a product supporting surface 92. For instance, the dividing wall 90 may be attached to a pair of end clips 60 such that one is positioned at each end (see FIGS. 1 and 5). In this configuration, the end clips 60 could attach the dividing wall 90 to the front panel 20 and alternatively also the rear panel 22 for sliding movement therein. As discussed above, the dividing wall 90 may also be combined with a product track 70 such as that illustrated in FIG. 5.

With reference to FIG. 5, the product track 70 is generally comprised of the same rails, ribs, lower support surface and tie down surfaces 72, 74, 76, 78 as discussed above. However, the lower support surface 76 extends to both sides of the product track 70 and includes a pair of upwardly extending ribs 94 that serve to carry a product. The upwardly extending ribs 94 also decrease friction between the product and the product track 70 by decreasing surface contact area. Additionally, the lower support surface 76 extends outward into a dividing wall 90 at one of the left or right ends. The particular configuration of the product tracks and dividing walls may vary upon application to allow proper sizing of the product supporting and feeding assembly for any specific shelf management system 10. The product supporting and feeding assembly 14 described thus far advantageously allows a store operator to quickly and easily reconfigure the shelves within the store to accept products of varying sizes and shapes without ordering a complete replacement shelf management system. Moreover, the versatility of the present adjustable shelf management system 10 is dramatically increased by the interchangeable nature of the product tracks 70 and dividing walls 90, as well as the combined product tracks/dividing wall described directly above.

While it has been disclosed that one end 50, 52 of the frame 12 may be removed to allow the replacement and/or removal or addition of a product track 70 or a dividing wall 90, as shown in FIG. 10, it is also envisioned that a product track 70 or dividing wall 90 may simply be snap fit into the frame 12 and shelf 200 such that the end clips 60 and the shelf attachment extensions 21, 42 attach the track 70 or dividing wall 90 for sliding movement relative to the frame after being snapped in. Along these lines, the tracks 70 and walls 90 may be configured similar to a ski boot binding wherein the front of the track 70 or dividing wall 90 is slipped into the front panel 20 and then snapped into place in the other of the panels 22 or a rear panel can be set over the back of the product tracks 70 such that they are held into a fixed position relative to one another or to the dividers and are attached to the shelf at both the front and rear. Alternatively, the rear panel could simply be placed over the tracks 70 and walls 90 and not attached to the shelf 150. In one embodiment, the upper flange 32 may have increased flexibility to allow the end clip 60 to slide in more easily. Additionally or alternatively, the angle on the inside top of the flange 32 can be changed to allow this flexibility.

Additionally, the front and rear panels may include an entrance slot such that product tracks 70 and dividing walls 90 may be inserted and/or removed in various locations along the length of the panels. In further embodiments, the product tracks 70 and dividers 90 have separate fronts 20 which allow each track to be separately attached to the shelf 150 and snap fit into the slot in the shelf. Additionally, the product tracks 70 and the dividing walls 90 may be separated by spacer blocks 96 such as those illustrated in FIG. 3. The spacer blocks may be arranged and configured in any suitable manner and likewise may be attached to the front panel 20, rear panel 22, or any of the dividers 90 or product tracks 70.

Figure 7:
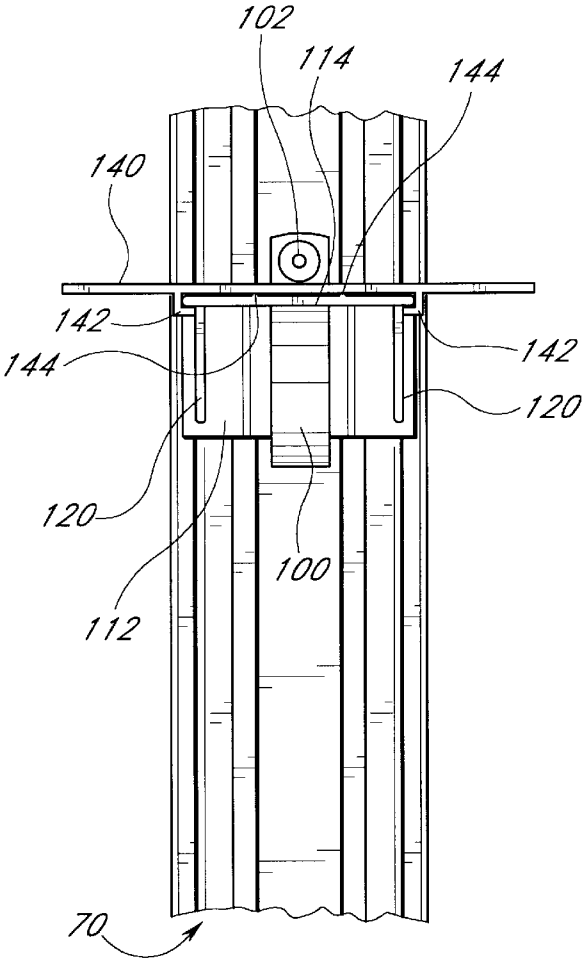
FIG. 7 is a top plan view of FIG. 6.

The product pusher comprises a spring which biases the product pusher toward the end of the track and a sliding connection between the track and the product pusher. With reference now to FIGS. 6–8, the biasing assembly for the forward feeding product supporting and feeding assembly 14 will be described in detail. As illustrated therein, the biasing member is preferably a roll spring 100. The roll spring 100 has characteristics which make it desirable over various other springs, such as compression springs. For instance, the roll spring 100 naturally recoils after being extended and released. The recoiling involves rolling of the coil into its tightly wound initial state. As the roll spring 100 is stretched, the force exerted by the roll spring 100 varies unlike that of coil springs in which the force is approximately the same during such stretching.

Of course, coil springs may be used, however, they are not the presently preferred embodiment. Moreover, elastic straps, ropes, and a variety of other springs and biasing members may be used. However, they are not the presently preferred biasing member for a number of reasons. A roll spring provides a uniform force throughout its extension, is simple to install and doesn't require attachment to the pusher block. The roll spring 100 may be permanently, semi-permanently or removably attached to the product track 70. It is presently preferred, however, that the roll spring 100 be permanently or semi-permanently attached to the product track 70 through the use of a rivet 102. It is envisioned, however, that threaded fasteners, fasteners, pins, connectors and couplings of any suitable type may also be used.

The balance of the roll spring 100 rests on a spring carrying surface 110 of a product pusher or pusher block, indicated generally by the reference numeral 112. Due to the unique configuration of the roll spring, no permanent attachment or semi-permanent attachment is necessary to maintain the spring's position on the spring carrier surface. Indeed, the forward tension of the roll spring which would be opposed by any product positioned forward of the pusher block 112 would help to maintain the position of the roll spring 100 on the spring carrier surface 110.

Figure 3:
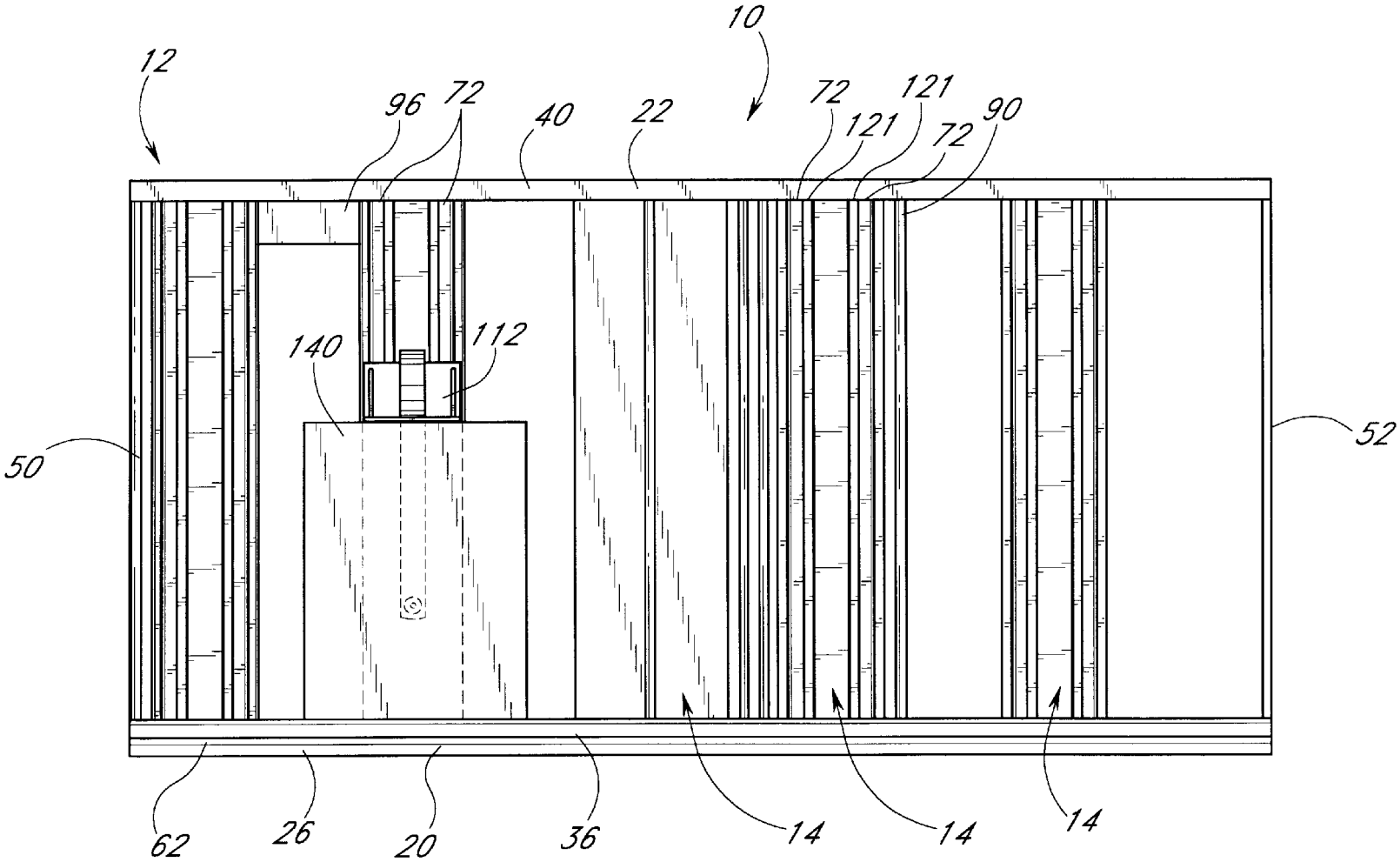
FIG. 3 is a top plan view of the adjustable shelf management system of FIG. 1.

With reference now to FIG. 8, it may also be seen that the forward portion of the roll spring may be positioned and attached to the forward end clip 60 in any suitable manner. In this way, the pusher block 112 may slide all the way forward to the product retaining wall 36 rather than being artificially stopped by the position of the rivet 102 or other attachment method of the, forward end of the roll spring 100. In embodiments such as the one illustrated in FIG. 8 in which the pusher block can traverse substantially the entire length of the product track 70, a spacing member 140 may be positioned forward of the pusher block 112 along the product track 70 such that the forward motion of the pusher block 112 may be limited as shown in FIG. 3. For example, as shown in FIG. 3, the paddle 140 can be positioned on the rails/ridges 72 between the product and the front panel 20. In continued reference to FIG. 8, the forward portion of the roll spring 100 is bent upward in position resting on the spring carrier surface 110 of the pusher block 112 and held in position by forces exerted between the end clip 60 and the lower support surface 34. This, in effect, captures the end of the roll spring 100 within the end clip. However, the spring is recessed in the end clip such that it is still slidable in the races.

The illustrated product pusher is in sliding connection with the product track. In general, the connection comprises a first and second pair of surfaces, with the first pair located adjacent the first rail or side of the track. One surface of the first and second pairs is on the track and the other surface of each of the first and second pairs is on the product pusher. The first and second pairs of surfaces engage to resist separation of the product pusher from the track. Additionally, there is a third pair of surfaces located between the first rail or side of the track and the second rail or side of the track. One surface of the third pair is on the track and the other surface of the third pair is on the product pusher. The third pair of surfaces engages to resist separation of the product pusher from the track. Preferably, with reference to FIGS. 6 and 9, the first and second pair of surfaces generally comprise the interaction between the outside flanges 122 of the pusher block 112 and the rails/ridges 72, while the third pair of surfaces generally comprise at least one arm 128 of the middle pusher block flange and another surface of the rails/ridges 78. With reference now to FIGS. 1 and 6–9, the product pusher or pusher block 112 in the preferred embodiment will be described in further detail. The pusher block 112 generally comprises the spring carrier surface 110, a pushing surface 114, a sliding surface 116, and two sets of opposing flanges 118. As explained, the opposing flanges 118, generally capture the rails or ridges 72 of the product track 70 to maintain a positive lock on the product track 70 by the pusher block 112. As illustrated in FIG. 8, the pushing surface 114 extends generally normal to the upper surface of the product track 70. The pushing surface 114 is designed to allow the pusher block 112 to maintain contact with the packaging positioned directly in front of the pusher block 112. The spring carrier surface 110 and the sliding surface 116 are generally formed from the same section of material which extends rearward of the pushing surface 114 along a direction generally perpendicular to the pushing surface 114. In the illustrated embodiment in FIGS. 6 and 7, a pair of gussets 120 support the relationship between the pushing surface 114 and the spring carrier surface 110. The outer edges of the spring carrier surface 110 are rolled downward and inward in the illustrated embodiment. These rolled edges 122 form one of the opposing flanges of each of the two sets of opposing flanges. Along the spring carrier surface 110, proximate the central portion of the spring carrier surface are two ridges 121. These ridges serve to maintain the position of the roll spring 100 on the pusher block 112.

Figure 9:
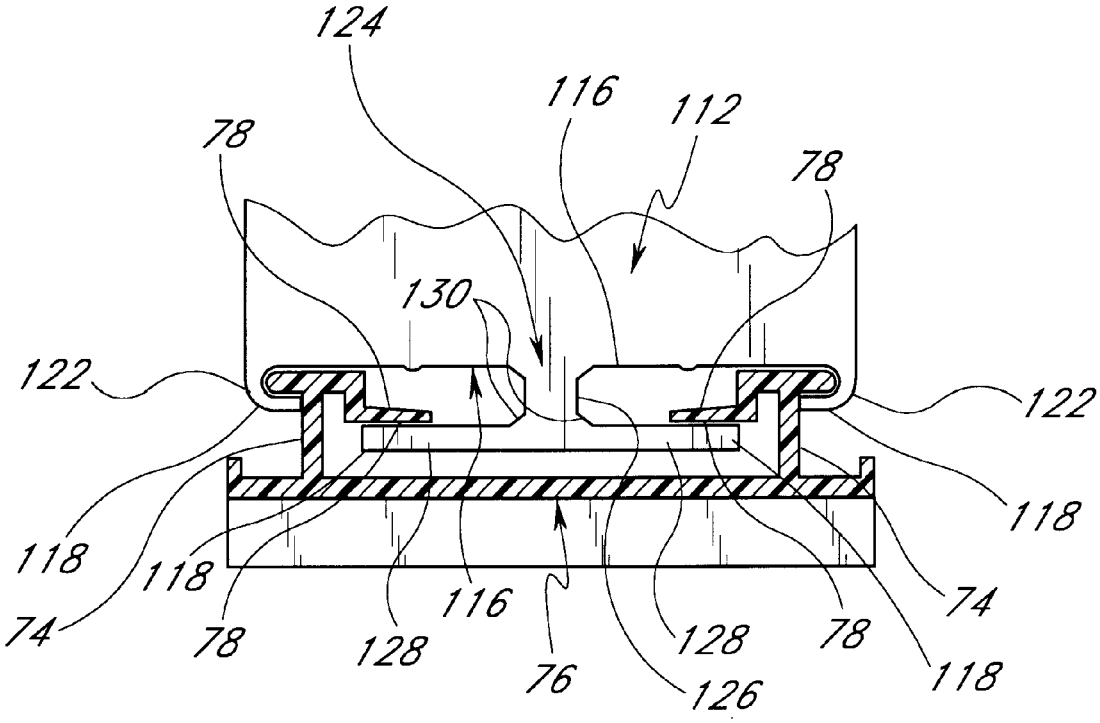
FIG. 9 is a front view of the pusher block and product track of the present invention taken through line 9—9 of FIG. 8.

With reference now to FIG. 9, as well as FIG. 6, the second of the opposing flanges is formed by a generally T-shaped boss 124 which extends downward from the sliding surface 116. The T-shaped boss 124 is designed to slide under the lower-most edge of the tie down surface 78. The T preferably has a pair of chamfers 130 formed along its stem 126. Specifically, the chamfers 130 are formed between the sliding surface 116 and the stem 126 and the stem 126 and the laterally extending arms 128. Through the use of the arms 128 and the rolled edges 122, the two sets of opposing flanges grip each of the rails 72 of the product track 70 to form a positive lock between the product track 70 and the pusher block 112. This positive lock reduces the likelihood of the pusher block 112 separating from the product track 70 under high load. The chamfers 130 reduce the contact surface area between the product track 70 and the pusher block 112 as well as center a vertical direction the pusher block 112 on the product track 70. Moreover, the bottom edge of the arms 128 serve to direct the roll spring 100 down toward the lower-most surface of the track, as well as serve to provide an idler arm to the roll spring 100 in some embodiments.

Alternatively, the pusher block 112 may be attached to the rails in a reverse orientation to that presented above such that the product is directly contacting the angled side of the pusher block.

Various accessories may be added to the adjustable shelf management system 10 configured and arranged in accordance with the present invention. For instance, with reference to FIGS. 6 and 7, an increased size pushing paddle 140 is illustrated therein. The pushing paddle 140 increases the contact surface area between the product being moved forward and the pusher block 112. Specifically, the paddle 140 is arranged with a pair of inwardly extending flanges 142 that are sized and configured to create a channel that slip fits over the pushing surface 114 of the pusher block 112. Moreover, the paddle 140 comprises a pair of ridges 144 that decrease the contact area between the paddle 140 and the pushing surface 114 such that the paddle may be easily removed or positioned on the pushing surface 114 as desired. The paddle 140 can also be used as in FIG. 3 as a spacing member.

Generally, the adjustable shelf management system 10 may be comprised of any suitable material. Materials presently preferred are materials from the styrene family or self-lubricating FDA approved plastics, such as, but not limited to, acrylonitrile-butadiene-styrene (ABS). In some embodiments, however, the components may be manufactured from stainless steel, UHMW, or other FDA approved materials. The materials are chosen to allow for easy cleaning and reduce adsorption of liquids. In applications not involving food products, the materials may be chosen from any material considered desirable to those of the user. Where materials are not judiciously chosen to result in a self-lubricating nature to the product, materials such as brass or bronze or any other bearing type surface material may be utilized with steels and the like. Additionally, a silicon spray may be used to coat the surfaces to increase the lubrication between the moving components. In some embodiments, the front panel 20 may be opaque, transparent or translucent. In the present and preferred embodiment, the front panel 20 is comprised of a clear plastic material to allow the prospective purchaser a clear line of vision to the product being carried by the adjustable shelf management system 10.

In use, the shelf management system is sized and configured using various product tracks 70 and dividers 90 to closely approximate the size of the packaging of the products being carried. It is anticipated that multiple product tracks 70 may be aligned side-by-side to carry heavier products such that a divider need not be placed directly between each and every product track 70. The end pieces 50 and 52 may be a product track 70 or a dividing wall 90. With the assembly complete, product may be loaded into the shelf management system 10 by pulling the pusher block 112 toward the rear panel 22 while stocking the product forward of the pusher block 112. As products are removed from between the pusher block 112 and the front panel 20, the pusher block will be urged forward under the bias of the roll spring 100 until the supply of product is depleted. When restocking, the pusher block 112 is simply slid rearward and the new product is positioned rearward of the old product to ensure a continuous cycling of product.

The ability to slidably move the tracks and dividers, the ability to add and remove tracks and dividers, and the ease with which this is done makes the shelf management system of the present invention infinitely variable with respect to width of a product.

It will be appreciated that the shelf management system of the present invention is extremely versatile and can be constructed and configured to display products of varying size and configuration in side by side relation. For example, a mixture of wider and thinner products could be displayed in the same rack by simply varying the width of the product tracks and dividers or adding different sized product tracks and dividers. In addition, products with a wide variety of heights can be displayed by varying the height of the front panel, or varying the size of the pusher block by adding variously sized spacer blocks. Although, the preferred embodiments of the invention have been described, various modifications come to mind without departing from the spirit of the invention.

The dividers and the product tracks, for instance, could assume any configuration as long as they are still slidably and stably positioned into the race at the front and alternatively also at the back of the shelf management system. The attachment directly to the shelf allows for greater stability of the products and the shelf management system. The shelf management system could also be configured in a variety of sizes to accommodate much larger products.

An alternative embodiment will now be described with reference to FIG. 11. In this embodiment the product tracks 70 and dividers 90 are separate. The front 20 is approximately the width of the product track 70 or divider 90, although the width of the front 20 is variable. The shelf extension 21 can be any width equal to or less than the width of the front 20. The embodiment shows a tab-like shelf extension 21. The front can be attached to the product track 70 or divider 90 in any way which allows it to be stably held into place. Examples of such methods include but are not restricted to screws, rivets, glue, and removable but stable methods. The front can be attached to the end piece 60, or alternatively some other part of the product track or divider, depending on the method of attachment. The tabs on the tracks 70 and dividers 90 hold these elements in place on the shelf 150, properly separated from one another.

Figure 12:
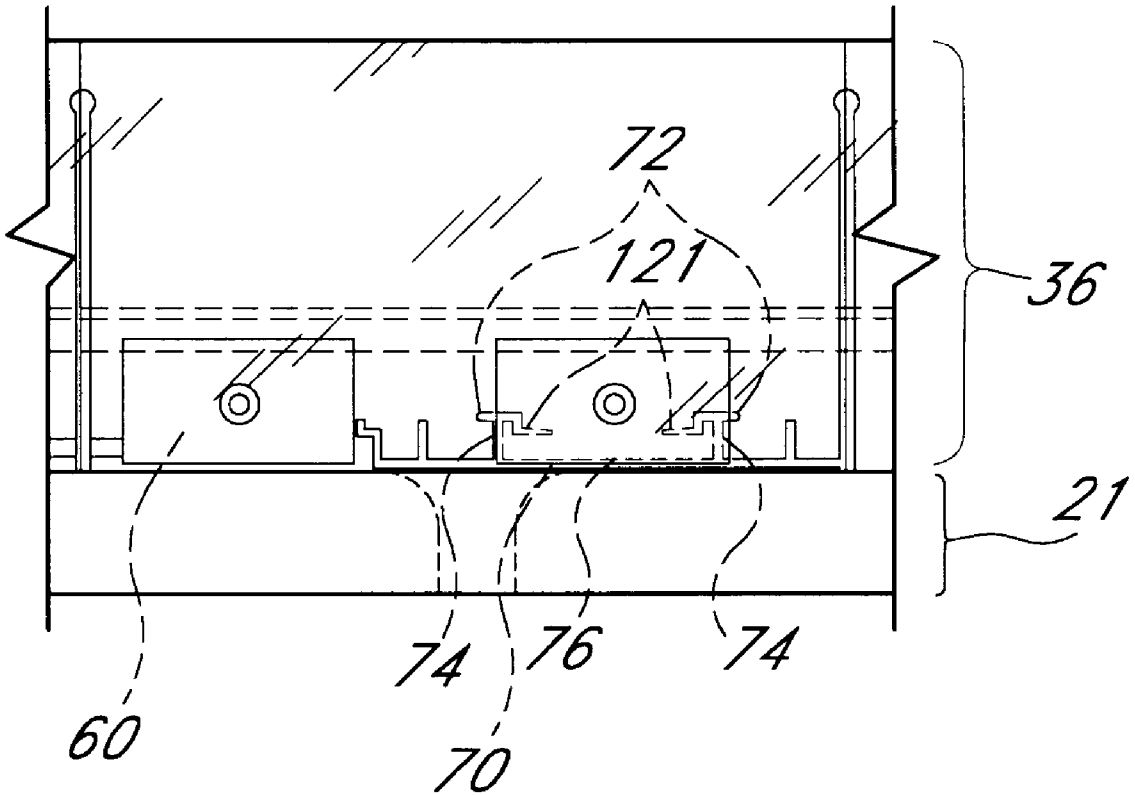
FIG. 12 is a front view of an alternative embodiment in which the front panel is shortened to about the width of a product track and its associated dividers.

With reference to FIG. 12, it can be seen an alternative embodiment involves product tracks 70 and dividers 90 which are integrally formed. In such a case, the front 20 is approximately the width of the product track and divider combination, although the width of the front 20 is variable. The shelf extension 21 can be any width equal to or less than the width of the front 20. The embodiment shows a tab-like shelf extension 21. The front can be attached to the integrally formed product track and divider combination 70 in any way which allows it to be stably held into place. Examples of such methods include but are not restricted to screws, rivets, glue, and removable but stable methods. The front can be attached to the end piece 60, or alternatively some other part of the product track or divider, depending on the method of attachment.

Figure 11:
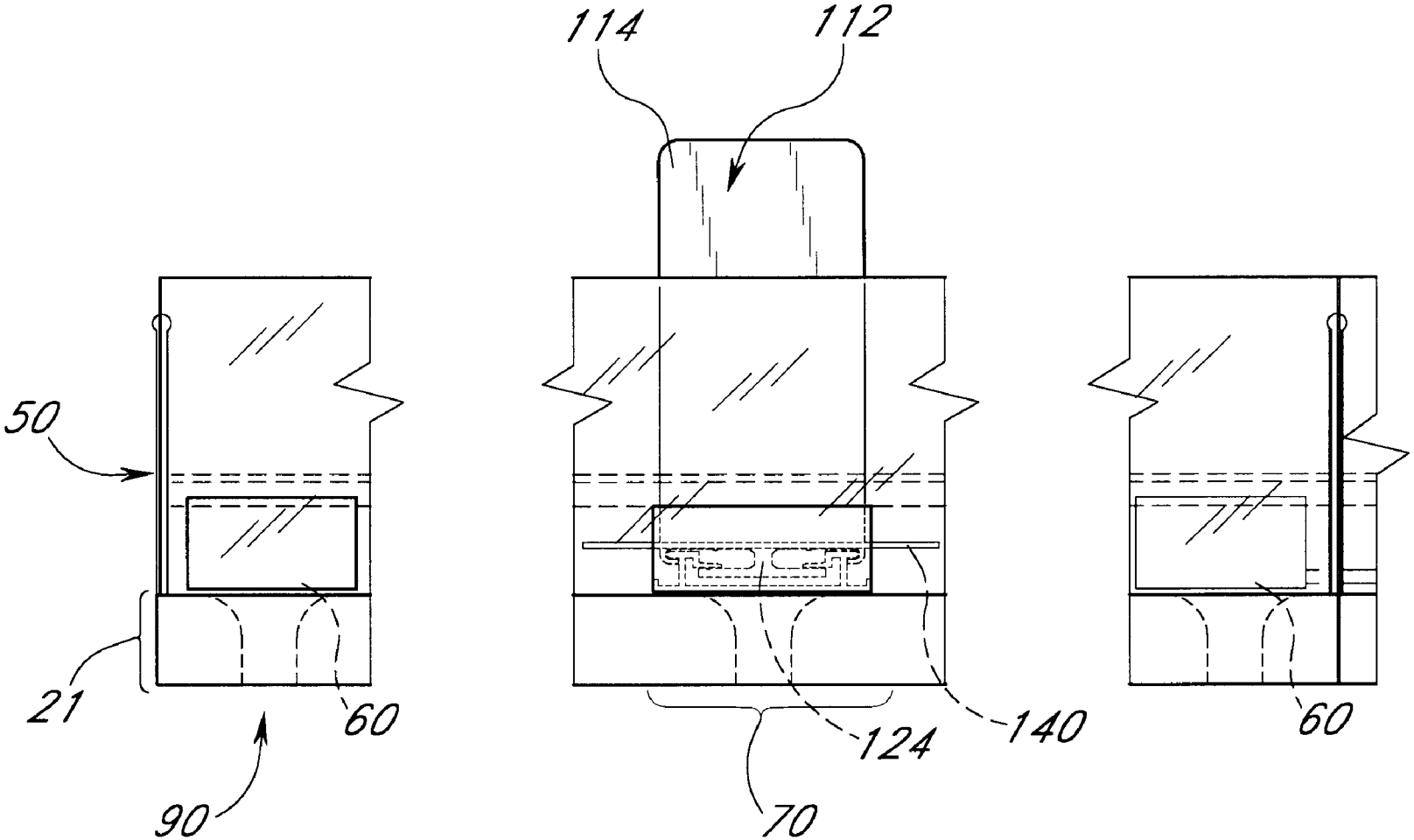
FIG. 11 is a front view of an alternative embodiment in which plural front panels are used to attach a product track and adjacent dividers to a shelf.

The embodiments illustrated by FIGS. 11 and 12 provide a further level of adjustability, allowing for the complete use of a shelf of any width. Because each separate product track 70 and divider 90 can be inserted in the shelf slot 152, the shelf management system can be configured in such a way that a shelf of any size can be completely used. This allows for unlimited variation: as previously mentioned, products of any size can be accommodated, or a variety of sized products can be accommodated, and now, the products can be arranged in such a way that all of the shelf space is used.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Also, some of the components may be formed in the leash housing itself, such as the bag carrier, and bosses may be formed in the housing for rings and the like. Moreover, not all of the features, aspects and advantages are necessarily required to practice the present invention. Accordingly, the scope of the present invention is intended to be defined only by the claims that follow.

What is claimed is:

1. A shelf management system for storing and displaying products on a shelf, the shelf having a front and a support surface that extend along a length of the shelf, said shelf management system comprising:

a product track adapted to extend generally transverse to the length of the shelf and adapted to be positioned in multiple locations along the length of the shelf;

a pusher block slidably attached to said product track;

a biasing member adapted to urge said pusher block toward an end of said product track that is closer to the front of the shelf;

a flange being connected to said track and being adapted to extend into the shelf; and a rear panel attached to said product track, said rear panel comprising a rear flange adapted to extend into the shelf.

2. The shelf management system of claim 1 additionally comprising a product divider extending generally parallel to said track.

3. The shelf management system of claim 2, wherein said product track and said divider are formed as a single piece.

4. The shelf management system of claim 1, wherein said shelf management system has a length and said flange extends along substantially the entire length of said shelf management system.

5. The shelf management system of claim 1, wherein said shelf management system comprises a front member that is attached to said track and said flange extends from said front member.

6. The shelf management system of claim 5, wherein said flange comprises protuberances that are adapted to secure said flange to the shelf.

7. The shelf management system of claim, 5, wherein said front member is transparent.

8. The shelf management system of claim 5, wherein said front member is angled rearward.

9. The shelf management system of claim 1, wherein said biasing member is attached to said pusher block and to said product track.

10. The shelf management system of claim 1, wherein said product track comprises a pair of raised rails each having a generally T shape, and wherein said pusher block includes at least two sets of opposing flanges, wherein each said set of opposing flanges captures an outside and inside edge of a corresponding one of said rails.

11. The shelf management system of claim 1, wherein said biasing member is a roll spring.

12. The shelf management system of claim 1, wherein said pusher block further comprises a spacer block which fits onto said pusher block to increase the width for wider products.

13. The shelf management system of claim 1 in combination with the shelf, wherein the shelf comprises a slot and said flange is attached to the shelf by insertion into the slot in the shelf.

14. The shelf management system of claim 1 in combination with a shelf, wherein the shelf comprises a slot and said rear panel is attached to the shelf by insertion of the rear flange into the slot in the shelf.

15. The shelf management system of claim 1 additionally comprising a front member that is attached to said track, wherein said front member forms a front for said shelf management system.

16. A shelf and shelf management system for storing and displaying products, comprising:

a shelf having a slot and having a length;

at least one product track extending generally transverse along said shelf and having a transverse dimension substantially less than said length of said shelf such that said at least one product track can be adjusted laterally along said length of said shelf;

a pusher block slidable along said at least one product track;

a biasing member urging said pusher block along said at least one product track;

a tab extending below said at least one product track and into said slot, said tab extending from a front of said at least one product track; and a second tab attaching a rear of said at least one product track to said shelf.

17. A shelf management system comprising a first track and a second track, said first track having a first end, a second end and a lowermost surface extending generally between said first end and said second end, said second track also having a first end, a second end and a lowermost surface extending generally between said first end and said second end, said first end of said first track and said first end of said second track being connected to a front panel, said front panel having a length, said first track and said second track capable of being repositioned along at least a portion of the length of said front panel, said front panel comprising a lower extension portion that is arranged to extend vertically downward lower than the lowermost surface of said first track and the lowermost surface of said second track, and said extension portion being adapted to mount in a receiving slot of an associated shelf.

18. The system of claim 17, wherein said front panel comprises at least one rearwardly extending lip, said lip generally adapted to hold said first track and said second track in relative position on the shelf.

19. The system of claim 18, wherein said first track comprises at least one end cap and said end cap is secured under said lip of said front panel.

20. The system of claim 18, wherein said first track is capable of sliding along the length of said front panel when held in relative position.

21. The system of claim 20 in combination with a shelf, said shelf comprising an upper support surface and said first track being generally sandwiched between said upper support surface of said shelf and said lip of said front panel.

22. The system and shelf of claim 21, wherein said shelf comprises a slot and said extension portion of said front panel is received within said slot.

23. The system and shelf of claim 22, wherein said slot extends along a length of said shelf.

24. The system and shelf of claim 23, wherein said slot is substantially uninterrupted along its length.

25. A shelf management system for storing and displaying products on a shelf, the shelf having a front and a support surface that extend along a length of the shelf, said shelf management system comprising:

a product track adapted to extend generally transverse to the length of the shelf and adapted to be positioned in multiple locations along the length of the shelf;

a pusher block slidably attached to said product track;

a biasing member adapted to urge said pusher block toward an end of said product track that is closer to the front of the shelf; and a flange being connected to said track and being adapted to extend into the shelf, said shelf management system having a length and said flange extending along substantially the entire length of said shelf management system.

26. The shelf management system of claim 25, further comprising a rear panel attached to said track.

27. The shelf management system of claim 26, wherein said rear panel includes a flange adapted to extend into the shelf.

28. The shelf management system of claim 25 additionally comprising a product divider extending generally parallel to said track.

29. The shelf management system of claim 28, wherein said product track and said divider are formed as a single piece.

30. The shelf management system of claim 25, wherein said shelf management system comprises a front member that is attached to said track and said flange extends from said front member.

31. The shelf management system of claim 30, wherein said flange comprises protuberances that are adapted to secure said flange to the shelf.

32. The shelf management system of claim 30, wherein said front member is transparent.

33. The shelf management system of claim 30, wherein said front member is angled rearward.

34. The shelf management system of claim 25, wherein said biasing member is attached to said pusher block and to said product track.

35. The shelf management system of claim 25, wherein said product track comprises a pair of raised rails each having a generally T shape, and wherein said pusher block includes at least two sets of opposing flanges, wherein each said set of opposing flanges captures an outside and inside edge of a corresponding one of said rails.

36. The shelf management system of claim 25, wherein said biasing member is a roll spring.

37. The shelf management system of claim 25, wherein said pusher block further comprises a spacer block which fits onto said pusher block to increase the width for wider products.

38. The shelf management system of claim 25 in combination with the shelf, wherein the shelf comprises a slot and said flange is attached to the shelf by insertion into the slot in the shelf.

39. The shelf management system of claim 25 in combination with the shelf, wherein the shelf comprises a slot and said shelf management system additionally comprises a rear panel attached to said track and attached to the shelf by insertion into the slot in the shelf.

40. The shelf management system of claim 25 additionally comprising a front member that is attached to said track, wherein said front member forms a front for said shelf management system.

41. A shelf management system and shelf combination, said shelf management system being for storing and displaying products on the shelf, the shelf comprising a front, a slot and a support surface that both extend along a length of the shelf, said shelf management system comprising:

a product track extending generally transverse to the length of the shelf and adapted to be positioned in multiple locations along the length of the shelf;

a pusher block slidably attached to said product track;

a biasing member urging said pusher block toward an end of said product track that is closer to the front of the shelf;

a flange being connected to said track and being adapted to extend into the shelf; and a rear panel attached to said product track and being attached to the shelf by insertion into the slot in the shelf.

42. The shelf management system and shelf combination of claim 41, wherein said rear panel includes a flange adapted to extend into the shelf.

43. The shelf management system and shelf combination of claim 41 additionally comprising a product divider extending generally parallel to said track.

44. The shelf management system and shelf combination of claim 43, wherein said product track and said divider are formed as a single piece.

45. The shelf management system and shelf combination of claim 41, wherein said shelf management system has a length and said flange extends along substantially the entire length of said shelf management system.

46. The shelf management system and shelf combination of claim 41, wherein said shelf management system comprises a front member that is attached to said track and said flange extends from said front member.

47. The shelf management system and shelf combination of claim 46, wherein said flange comprises protuberances that are adapted to secure said flange to the shelf.

48. The shelf management system and shelf combination of claim 46, wherein said front member is transparent.

49. The shelf management system and shelf combination of claim 46, wherein said front member is angled rearward.

50. The shelf management system and shelf combination of claim 41, wherein said biasing member is attached to said pusher block and to said product track.

51. The shelf management system and shelf combination of claim 41, wherein said product track comprises a pair of raised rails each having a generally T shape, and wherein said pusher block includes at least two sets of opposing flanges, wherein each said set of opposing flanges captures an outside and inside edge of a corresponding one of said rails.

52. The shelf management system and shelf combination of claim 41, wherein said biasing member is a roll spring.

53. The shelf management system and shelf combination of claim 41, wherein said pusher block further comprises a spacer block which fits onto said pusher block to increase the width for wider products.

* * * * *